US007588520B2

(12) United States Patent
Nalley

(10) Patent No.: US 7,588,520 B2
(45) Date of Patent: Sep. 15, 2009

(54) DUMBBELL WEIGHT TRAINING DEVICE HAVING DETACHABLE WEIGHT PLATES

(76) Inventor: Mark Nalley, 41373 Avenida Dolores, Murrieta, CA (US) 92562

( * ) Notice: Subject to any disclaimer, the term of this patent is extended or adjusted under 35 U.S.C. 154(b) by 11 days.

(21) Appl. No.: 11/891,862

(22) Filed: Aug. 15, 2007

(65) Prior Publication Data

US 2009/0048079 A1 Feb. 19, 2009

(51) Int. Cl.
*A63B 21/072* (2006.01)

(52) U.S. Cl. ..... 482/107; 482/103; 482/104; 482/106; 482/108; 482/93; 482/98; 482/99; 482/908; D21/552; D21/680; D21/681; D21/682

(58) Field of Classification Search ..... 482/107, 482/103–106, 108; D21/552, 680–682
See application file for complete search history.

(56) References Cited

U.S. PATENT DOCUMENTS 1,026,215 A * 5/1912 Korth ..... 482/50
4,809,975 A * 3/1989 Lee ..... 482/110
4,822,034 A * 4/1989 Shields ..... 482/106
4,913,422 A * 4/1990 Elmore et al. ..... 482/106
5,154,681 A * 10/1992 Denny ..... 482/108
5,407,413 A * 4/1995 Kupferman ..... 482/106
5,464,379 A * 11/1995 Zarecky ..... 482/108
5,628,716 A * 5/1997 Brice ..... 482/106
5,779,604 A * 7/1998 Towley et al. ..... 482/108
5,839,997 A 11/1998 Roth et al.
5,842,961 A * 12/1998 Davis ..... 482/139
6,033,350 A * 3/2000 Krull ..... 482/98
D422,654 S * 4/2000 Chen ..... D21/681
6,186,928 B1 * 2/2001 Chen ..... 482/107
6,196,952 B1 * 3/2001 Chen ..... 482/107
6,228,003 B1 * 5/2001 Hald et al. ..... 482/107
6,261,022 B1 * 7/2001 Dalebout et al. ..... 482/107
6,416,446 B1 * 7/2002 Krull ..... 482/108
6,422,979 B1 * 7/2002 Krull ..... 482/98
6,500,101 B1 * 12/2002 Chen ..... 482/107
6,656,093 B2 * 12/2003 Chen ..... 482/108
6,749,547 B2 * 6/2004 Krull ..... 482/106
6,872,173 B2 * 3/2005 Krull ..... 482/108
6,899,661 B1 * 5/2005 Krull ..... 482/107
6,971,974 B2 * 12/2005 Bowman et al. ..... 482/107
6,974,405 B2 * 12/2005 Krull ..... 482/107
D516,639 S * 3/2006 Hamilton ..... D21/681

(Continued)

*Primary Examiner*—Loan H Thanh
*Assistant Examiner*—Robert F Long
(74) *Attorney, Agent, or Firm*—Morland C. Fischer

(57) ABSTRACT

Disclosed is a dumbbell of the type commonly found in a fitness center to be used as a weight training device during a weight training or exercise program. The dumbbell includes a gripping handle and a pair of collars fixedly connected to opposites ends of the handle. A series of weight plates having correspondingly different weights are adapted to be detachably connected to each other and to each one of the collars so as to enable a user to selectively and incrementally adjust the gross weight of the dumbbell to conform to his weight training program. Each weight plate carries a lock cartridge having an engagement pin moving therethrough between retracted and extended positions in response to a manual pushing force. In the extended position, the engagement pin of an additional weight plate is received within an engagement pin extension channel of an existing weight plate being carried by the dumbbell, whereby to prevent a disconnection of the additional weight plate from the existing weight plate.

12 Claims, 4 Drawing Sheets

U.S. PATENT DOCUMENTS 7,066,867 B2 * 6/2006 Krull ..... 482/108
7,077,791 B2 * 7/2006 Krull ..... 482/108
D528,173 S * 9/2006 Flick et al. ..... D21/686
D528,611 S * 9/2006 Flick et al. ..... D21/681
7,137,931 B2 * 11/2006 Liu ..... 482/107
7,137,932 B2 * 11/2006 Doudiet ..... 482/107
7,153,243 B1 * 12/2006 Krull ..... 482/107
D536,752 S * 2/2007 Walkerdine ..... D21/681
7,172,536 B2 * 2/2007 Liu ..... 482/108
D540,405 S * 4/2007 Crawford et al. ..... D21/681
D540,894 S * 4/2007 Crawford et al. ..... D21/681
7,198,591 B2 * 4/2007 Lien ..... 482/106
7,261,678 B2 * 8/2007 Crawford et al. ..... 482/107
7,291,098 B1 * 11/2007 Krull ..... 482/107
7,300,389 B2 * 11/2007 Lien et al. ..... 482/106
7,335,139 B2 * 2/2008 Bartholomew et al. ..... 482/97
7,377,885 B2 5/2008 Doudiet
7,413,533 B2 * 8/2008 Lin ..... 482/108
7,491,155 B2 * 2/2009 Fenelon et al. ..... 482/107
7,517,305 B2 * 4/2009 Lien ..... 482/106
2002/0022559 A1 2/2002 Krull
2004/0077466 A1 * 4/2004 Wallace et al. ..... 482/93
2005/0075221 A1 * 4/2005 Fond ..... 482/93
2006/0217245 A1 * 9/2006 Golesh et al. ..... 482/94
2007/0123398 A1 * 5/2007 Ljevaja ..... 482/107
2007/0173386 A1 * 7/2007 Wang ..... 482/107

* cited by examiner

DUMBBELL WEIGHT TRAINING DEVICE HAVING DETACHABLE WEIGHT PLATES

BACKGROUND OF THE INVENTION

1. Field of the Invention

This invention relates to a versatile dumbbell of the type commonly found in a fitness center to be used as a weight training device. The dumbbell is adapted to carry a set of interchangeable weight plates that are detachably connected to one another so that the gross weight of the dumbbell can be selectively and incrementally varied to fit a weight training program of the user.

2. Background Art

A dumbbell is a conventional weight training device that has long been used by body builders and others to improve their physical strength and appearance as part of a weight training or exercise program. Such a dumbbell typically includes a cylindrical gripping handle that carries a pair of weight plates at opposite ends thereof. In this regard, the weight plates are fixedly connected to the ends of the gripping handle. Should the user wish to increase the weight to be lifted, he must find an altogether different dumbbell. In other words, there is no way for the user to selectively adjust or progressively change the weight of a dumbbell to be used during a workout, such that the gross weight of each dumbbell remains the same at all times.

As a consequence of the foregoing, the fitness center or the user (should he elect to exercise at his home or office) must maintain many different dumbbells having characteristically different gross weights. Accordingly, the cost to acquire a variety of dumbbells and the space consumed as a result thereof are undesirably increased. Moreover, the user's ability to easily and quickly expand his personal weight training program is hampered by the requirement to have ready access to such different dumbbells.

Nevertheless, one commercially available adjustable weight dumbbell system is available by referring to U.S. Pat. No. 5,839,997. This patented dumbbell system is mechanically complicated. Therefore, users may experience confusion which may lead to mistakes when attempting to vary the gross weight of the dumbbell during a workout. In addition, the maximum weight that can be added to the dumbbell system is limited.

Hence, what is desirable is a mechanically simple and easy-to-use dumbbell weight training device having a series of interchangeable weight plates with correspondingly different weights that are adapted to be detachably connected to one another so that the gross weight of a single dumbbell may be selectively and progressively varied to conform to the weight training program of the user.

SUMMARY OF THE INVENTION

In general terms, a versatile dumbbell is disclosed herein of the kind that is typically found in a fitness center to be used as a weight training device. The present improvement advantageously permits a user to quickly and easily vary the gross weight of a single dumbbell by adding or removing different weight plates having correspondingly different characteristic weights. To this end, each weight plate is preferably of uniform size, thickness and (e.g., disc-like) shape. An outer body manufactured from a durable (e.g., urethane) material surrounds a steel core, the size and weight of which determines the overall weight of the weight plate.

The dumbbell includes a pair of disc-like collars fixedly connected to opposite ends of a cylindrical gripping handle.

One or more weight plates are detachably connected to each collar. Each weight plate has opposing inside and outside faces. A radial coupling slot is formed in the inside face of each weight plate. A cartridge cavity is also formed in the inside face adjacent the coupling slot. An engagement pin receiving channel extends between the coupling slot and the cartridge cavity. A locking cartridge is located within the cartridge cavity at the inside face of the weight plate. The locking cartridge is operable to couple an additional weight plate to an existing weight plate being carried at one end of the gripping handle. A radial coupling body projects outwardly from the outside face of each weight plate. An engagement pin extension channel runs laterally through the coupling body. The coupling body at the outside face of an existing weight plate is sized and shaped for receipt within the coupling slot at the inside face of an additional weight plate such that the additional and existing weight plates are aligned face to face one another.

The locking cartridge received within the cartridge cavity of the additional weight plate includes an engagement pin and a control knob connected to one end of the engagement pin and accessible at the periphery of the weight plate. A pushing force applied in a first direction to the control knob causes the engagement pin to move through the locking cartridge of the additional weight plate from a retracted position to an extended position. In the extended position, the engagement pin rides through the engagement pin receiving channel and into the engagement pin extension channel that is formed in the coupling body of the existing weight plate. The receipt of the engagement pin within the engagement pin extension channel prevents a separation of the coupling body of the existing weight plate from the coupling slot of the additional weight plate, whereby the additional weight plate is detachably connected and locked to the existing weight plate.

A pushing force applied in an opposite direction to the control knob causes the engagement pin of the locking cartridge of the additional weight plate to move from the extended position to the retracted position so as to ride out of the engagement pin extension channel in the coupling body of the existing weight plate. Accordingly, the coupling body of the existing weight plate can now be separated from the coupling slot of the additional weight plate, whereby the additional weight plate is disconnected from the existing weight plate.

DESCRIPTION OF THE PREFERRED EMBODIMENT

Figure 1:
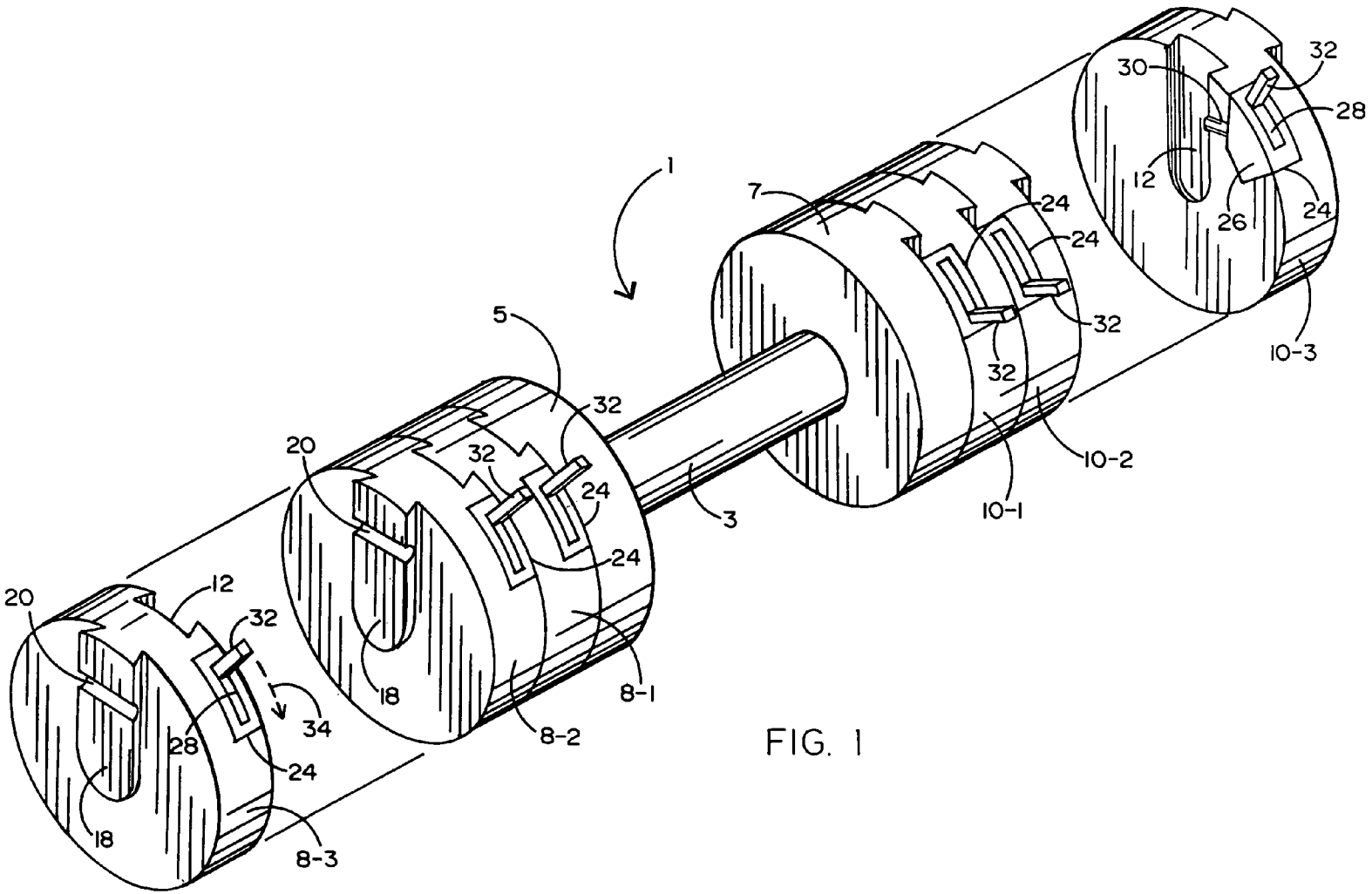
FIG. 1 is an exploded view illustrating an easy to use, adjustable weight dumbbell according to a preferred embodiment of this invention having a series of interchangeable weight plates adapted to be detachably connected to one another in face-to-face alignment at opposite ends of a gripping handle.

Referring to FIG. 1 of the drawings, there is shown a versatile dumbbell 1 of the type to be used as a personal exercise and weight training device. Thus, the dumbbell 1 will be typically found at a fitness center or at home to be repeatedly lifted by one seeking to improve his physical appearance, strength and conditioning. Although it is contemplated that the dumbbell 1 shown in FIG. 1 will be grasped in a single hand of a user, the teachings of this invention are also applicable to a larger bar bell device of the type to be grasped and lifted with both hands of the user.

Figure 9:
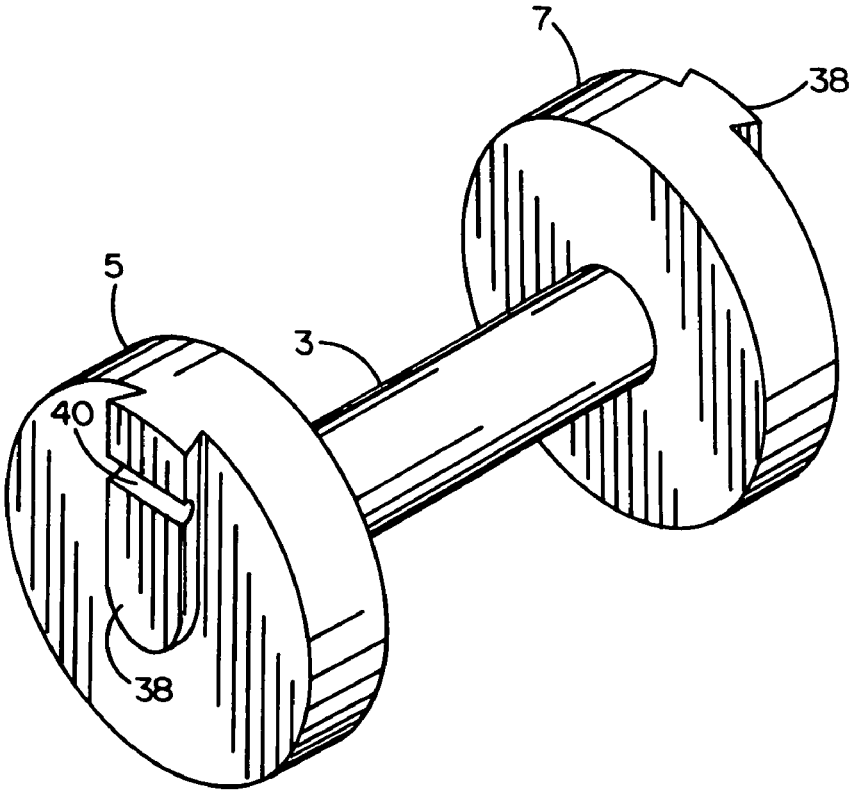
FIG. 9 shows the dumbbell of FIG. 1 with all of the weight plates removed therefrom.

The dumbbell 1 has a cylindrical handle 3 that extends between and is fixedly connected to opposing collars 5 and 7 (best shown in FIG. 9). The handle 3 is sized to be gripped within a single hand of a user. In the event that the teachings of this invention are applied to a bar bell, the length of handle 3 is extended to accommodate both hands of the user. As will be explained in greater detail hereinafter, a variable number of weight plates 8 and 10 can be detachably connected to each other and to respective ones of the collars 5 and 7 at opposite ends of the gripping handle 3. Ideally, a total of four weight plates 8 and 10 will be detachably connected to each collar 5 and 7. However, any suitable number of weight plates can be carried by the dumbbell 1. By virtue of being able to vary the number of weight plates 8 and 10 to be carried by dumbbell 1, the gross weight of the dumbbell can be selectively and incrementally changed so as to be tailored to conform to the weight training program of the user.

Figure 2:
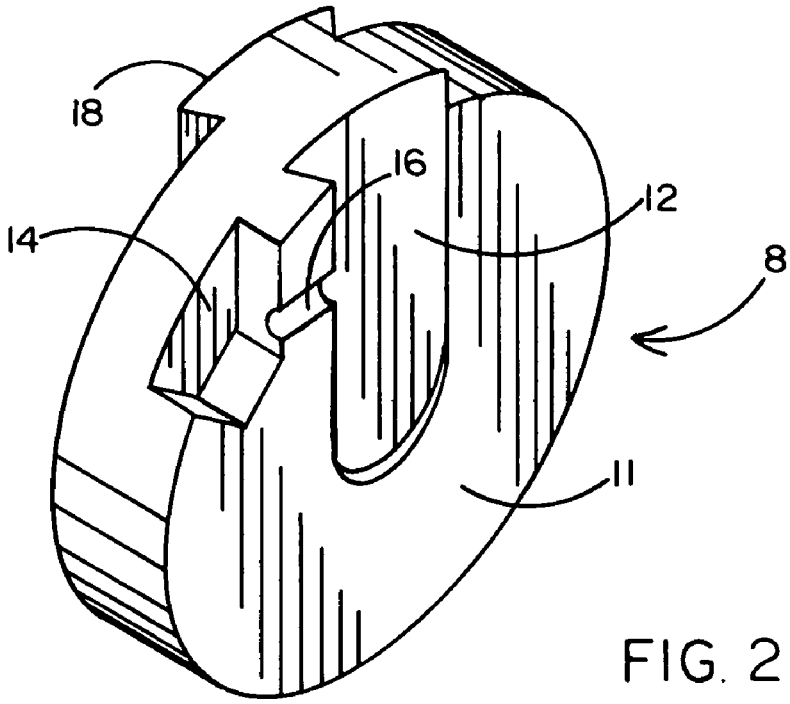
FIG. 2 shows the inside face of each weight plate of the adjustable weight dumbbell of FIG. 1.
Figure 3:
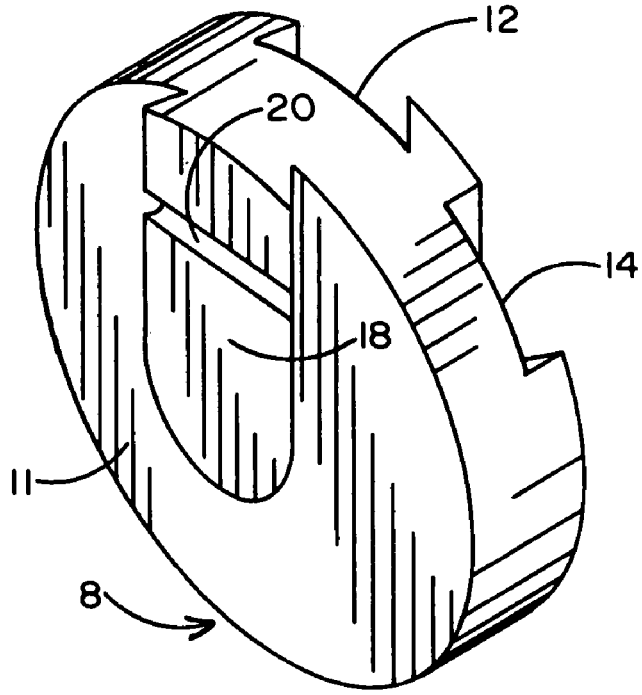
FIG. 3 shows the outside face of each weight plate of the adjustable weight dumbbell of FIG. 1.

Details of the weight plates 8 and 10 to be detachably connected to each other and to the collars 5 and 7 at opposite ends of gripping bar 3 are initially described while referring to FIGS. 2 and 3 of the drawings. Each weight plate (e.g., 8) preferably has an identical size, thickness and (e.g., disc-like) shape. Each weight plate 8 also preferably has a solid steel core (not shown) that is surrounded by an outer casing 11 manufactured from a durable, impact-resistant (e.g., urethane) material. The precise weight of the weight plate 8 will depend upon the corresponding size and weight of its steel core. In this regard, it is contemplated that a series of weight plates will be available at 2½ pound increments. Such a series of weight plates can be conveniently stored on a dumbbell rack to enable the user to pick and choose among particular ones of the weight plates to be detachably connected to each other and to the collars 5 and 7 (of FIG. 1) so that a dumbbell can be quickly and easily assembled to meet the weight training needs of the user. By virtue of the foregoing, the user will not be required to accumulate a variety of expensive and space-consuming dumbbells for each of the different weight combinations available by coupling different ones of the individual weight plates 8 and 10 of the dumbbell 1 of this invention.

Each weight plate 8 includes opposing inside and outside faces. As is best shown in FIG. 2, a radial coupling slot 12 is formed (e.g., molded) in the outer casing 11 at the inside face of weight plate 8. A cartridge cavity 14 is also formed (e.g., molded) in casing 11 at the inside face of weight plate 8 to lie adjacent coupling slot 12. A relatively narrow engagement pin receiving channel 16 extends between the cartridge cavity 14 and the coupling slot 12. As is best shown in FIG. 3, a radial coupling body 18 projects outwardly from casing 11 at the outside face of weight plate 8. An engagement pin extension channel 20 is formed in and runs laterally across coupling body 18.

As will soon be described, the radial coupling body 18 projecting from the outside face of a first weight plate (e.g., designated 8-1 in FIG. 1) is sized and shaped to be received within an oppositely aligned radial coupling slot 12 that is formed at the inside face of an adjacent weight plate (e.g., designated 8-2 in FIG. 1). Moreover, a removable locking cartridge (designated 24 in FIGS. 4 and 5) is sized and shaped to be received by the cartridge cavity 14 formed at the inside face of each weight plate 8.

A description of the aforementioned removable locking cartridge 24 and the receipt of cartridge 24 within cartridge cavity 14 is now provided while referring concurrently to FIGS. 4-7 of the drawings. The locking cartridge 24 may be the same as that described in my co-pending patent application Ser. No. 11/349,101 filed Feb. 8, 2007, the teachings of which are incorporated herein by reference. Therefore, and for purposes of efficiency, only a brief description of the operation of locking cartridge 24 will be provided. The removable locking cartridge 24 carried by each detachable weight plate 8 of the dumbbell 1 (of FIG. 1) includes a lock body 26. A longitudinal guide slot 28 extends through the lock body 26 of locking cartridge 24. One end of an engagement pin 30 projects outwardly from the guide slot 28 at the bottom of cartridge 24. A manually-accessible control knob 32 is attached to the opposite end of engagement pin 32 at the top of locking cartridge 24 along the periphery (i.e., circumference) of weight plate 8.

Figure 4:
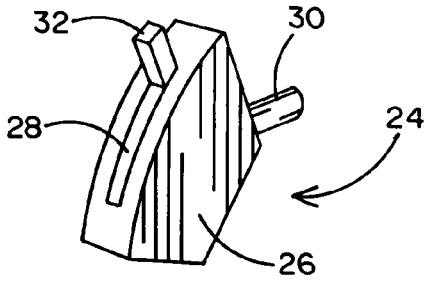
FIG. 4 shows a locking cartridge that is operable for coupling an additional weight plate to an existing weight plate and having an engagement pin moved to a retracted position.
Figure 5:
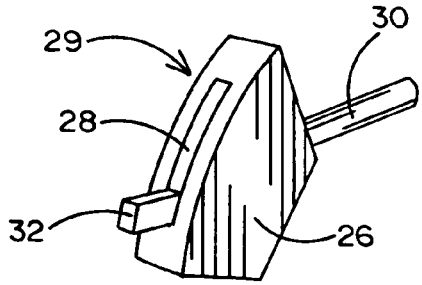
FIG. 5 shows the locking cartridge of FIG. 4 with the engagement pin thereof moved to an extended position.
Figure 6:
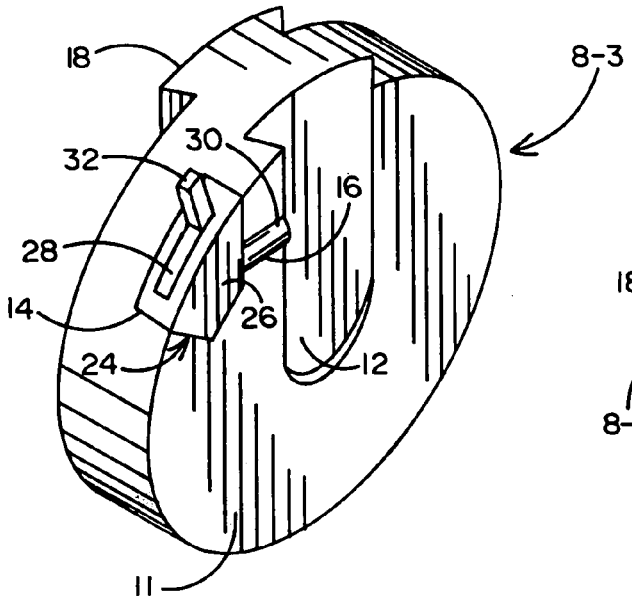
FIG. 6 shows the locking cartridge of FIG. 4 having the engagement pin thereof in the retracted position and being received within a cartridge cavity formed at the inside face of a first weight plate.
Figure 7:
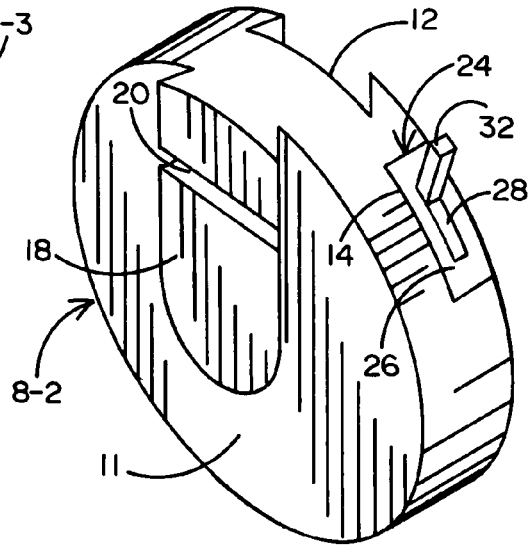
FIG. 7 shows the locking cartridge of FIG. 4 having the engagement pin thereof in the retracted position and being received within the cartridge cavity of another weight plate to be detachably connected to the weight plate of FIG. 6.

The control knob 32 is adapted to slide back and forth over the guide slot 28 through the lock body 26 of locking cartridge 24 to cause the engagement pin 30 to move between a retracted position (of FIG. 4) and an extended position (of FIG. 5). As previously disclosed, the locking cartridge 24 is removably received within the cartridge cavity 14 of each weight plate 8 (e.g., designated 8-3 and 8-2) in FIGS. 6 and 7. With locking cartridge 24 located in cavity 14, the engagement pin 30 thereof is aligned to slide through the engagement pin receiving channel 16 extending between the cartridge cavity 14 and the coupling slot 12 at the inside face of each weight plate 8-3. The engagement pin 30 will slide reciprocally through the engagement pin receiving channel 16 from its retracted position (as shown in FIG. 4) to its extended position (as shown in FIG. 5) in response to a pushing force applied by the user to the control knob 32 by which to cause the control knob to slide along the guide slot 28 through lock body 26.

When it is desirable to add more weight to the dumbbell 1 of FIG. 1, one or more additional weight plates (8-3 and 10-3) are detachably connected to respective existing weight plates 8-2 and 10-2 being carried at each end of the gripping handle 3. By way of specific example, and referring once again to FIG. 1, the additional weight plate 8-3 (of FIG. 6) is coupled to an adjacent existing weight plate 8-2 (of FIG. 7). To accomplish the foregoing, the additional weight plate 8-3 is moved into face-to-face alignment against existing weight plate 8-2, such that the radial coupling body 18 projecting from the outside face of weight plate 8-2 is received within the radial coupling slot 12 that is formed in the inside face of weight plate 8-3.

Figure 8:
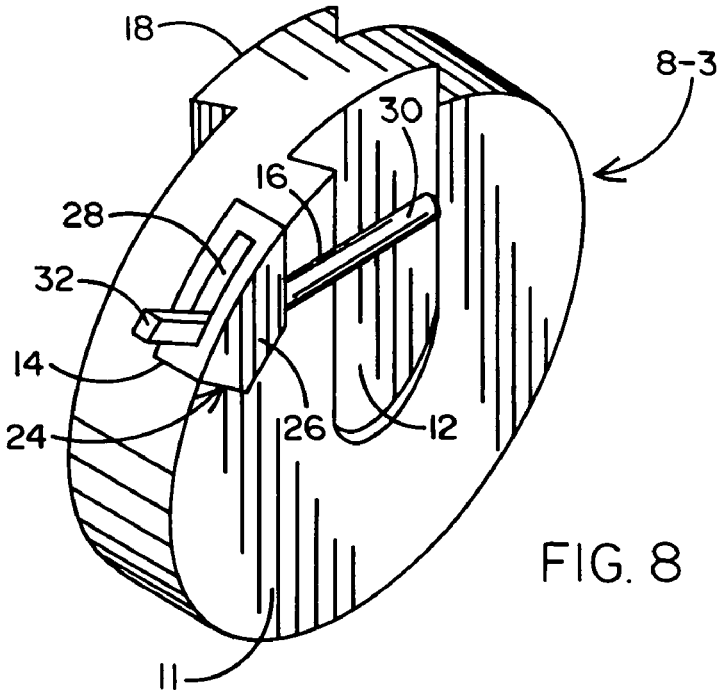
FIG. 8 shows the weight plate of FIG. 6 with the engagement pin of the locking cartridge thereof moved to the extended position.

Next, the user applies a pushing force to the control knob 32 of the locking cartridge 24 of the additional weight plate 8-3. The pushing force causes the control knob 32 to slide along the guide slot 28 (in the direction of reference arrow 34) of locking cartridge 24 by which to cause the engagement pin 30 to move from its retracted position (of FIG. 4) to its extended position (of FIG. 5). That is to say, the engagement pin 30 will travel through the engagement pin receiving channel 16 and into the coupling slot 12 of the weight plate 8-3 at which to engage the adjacent weight plate 8-2 at the axially-aligned engagement pin extension channel 20 that runs laterally through the coupling body 18 of weight plate 8-2. FIG. 8 of the drawings shows the additional weight plate 8-3 separated from its adjacent weight plate 8-2 of FIG. 1, but with the control knob 32 of locking cartridge 24 moved along guide slot 28 to cause the engagement pin 30 to move to the extended position across coupling slot 12 at which to engage weight plate 8-2 at the coupling body 18 projecting therefrom.

With the engagement pin 30 of the locking cartridge 24 moved to the extended position and located within the engagement pin extension channel 20 as just explained, the additional weight plate 8-3 will be detachably connected and locked to its adjacent existing weight plate 8-2 of dumbbell 1. The receipt of engagement pin 30 of weight plate 8-3 within the engagement pin extension channel 20 of weight plate 8-2 prevents an inadvertent separation of the coupling body 18 of weight plate 8-2 from the coupling slot 12 of weight plate 8-3. By detachably connecting the additional weight plate 8-3 to the existing weight plate 8-2, the user is able to selectively and incrementally increase the gross weight of the dumbbell 1.

Should it be desirable to remove weight plate 8-3 or disassemble the dumbbell 1, the control knob 30 of locking cartridge 24 is pushed in a direction opposite to that represented by the reference arrow 34 of FIG. 1. The engagement pin 30 of the locking cartridge 24 of weight plate 8-3 is correspondingly moved to the retracted position of FIG. 4. Accordingly, the engagement pin 30 is withdrawn from the engagement pin extension channel 20 in the coupling body 18 of existing weight plate 8-2 to enable the coupling body 18 to be removed from the coupling slot 12 of weight plate 8-3 whereby weight plate 8-3 can now be disconnected from weight plate 8-2. The disconnected weight plate 8-3 may be returned to a weight plate rack, and a different weight plate having a correspondingly different weight may be substituted therefor and detachably connected to the existing weight plate 8-2 in an identical manner to that just described with respect to weight plate 8-3.

FIG. 9 of the drawings shows the dumbbell 1 of FIG. 1 with all of the weight plates removed. In this case, only the opposing collars 5 and 7 and the handle 3 extending therebetween remain during periods of non-use. It will then be up to a user to add one or more weight plates (e.g., 8-1 and 10-2) as needed to respective collars 5 and 7 in the same manner that an additional and an existing weight plate are coupled to one another. Therefore, each collar 5 and 7 includes a radial coupling body 38 projecting from an outside face and having an engagement pin extension channel 40 running laterally thereacross.

In the assembled, ready-to-use dumbbell configuration of FIG. 1, the radial coupling body 38 from one collar (e.g., 5) is suitably sized and shaped to be received within the radial coupling slot 12 formed at the inside face of an adjacent weight plate (e.g., 8-1). The engagement pin extension channel 40 of coupling body 38 is correspondingly aligned to receive an engagement pin (designed 30 in FIGS. 4 and 5) from the locking cartridge 24 of weight plate 8-1, whereby the weight plate 8-1 will be detachably connected to the collar 5.

The invention claimed is:

1. A weight training device comprising a gripping handle at which said weight training device is lifted, a first weight plate connected to said gripping handle and having a coupling body projecting therefrom, and at least one additional weight plate to be detachably connected to said first weight plate, said additional weight plate having an engagement pin moving between retracted and extended positions relative to said first weight plate, said engagement pin being moved to the extended position at which to be removably received by said first weight plate, whereby said additional weight plate is detachably connected to said first weight plate, and said engagement pin being moved to the retracted position at which to be removed from said first weight plate, whereby said additional weight plate is disconnected from said first weight plate, said additional weight plate including a coupling slot aligned for receipt of the coupling body of said first weight plate and an engagement pin receiving channel communicating with said coupling slot, said engagement pin moving to the extended position and riding through the engagement pin receiving channel of said additional weight plate and into engagement with the coupling body of said first weight plate at said coupling slot, whereby said additional weight plate is lifted together with said first weight plate.

2. The weight training device recited in claim 1, wherein said gripping handle is a bar and said first and additional weight plates are coupled to one another in face-to-face alignment, such that such weight training device is a dumbbell.

3. The weight training device recited in claim 1, further comprising a position control knob attached to said engagement pin, said position control knob being manually accessible to receive a pushing force thereagainst for correspondingly causing said engagement pin to move to said retracted and extended positions depending upon the direction of said pushing force.

4. The weight training device recited in claim 3, further comprising a lock cartridge received within a cartridge cavity formed in said additional weight plate, said engagement pin being carried by said lock cartridge and movable therethrough between said retracted and extended positions in response to the pushing force applied against the position control knob attached to said engagement pin.

5. The weight training device recited in claim 1, wherein said coupling body projecting from said first weight plate for receipt by the coupling slot of said additional weight plate includes an engagement pin extension channel, said engagement pin riding through said engagement pin receiving channel and into receipt by said engagement pin extension channel, whereby the engagement pin of said additional weight plate is located in mating engagement with the coupling body of said first weight plate and said additional weight plate is thereby connected to said first weight plate.

6. A weight training device comprising:

a gripping handle at which said weight training device is lifted;

a collar fixedly connected to said gripping handle;

a first weight plate connected to said collar; and a second weight plate to be coupled to said first weight plate and lifted therewith, said second weight plate having an engagement pin movable between a retracted position, at which said second weight plate is disconnected from said first weight plate, and an extended position, at which said second weight plate is detachably connected to said first weight plate, said engagement pin moving between said retracted and said extended positions in response to a pushing force applied to said engagement pin, said first weight plate having an engagement pin channel formed therein, the engagement pin of said second weight plate being moved to the extended position at which to be received within said engagement pin extension channel to thereby prevent a disconnection of said second weight plate from said first weight plate, and said second weight plate having a coupling slot formed therein and said first weight plate having a coupling body projecting therefrom and aligned for receipt within the coupling slot of said second weight plate, said engagement pin channel being formed in the coupling body of said first weight plate, the receipt of said engagement pin by said engagement pin channel in said coupling body preventing a removal of said coupling body from said coupling slot and correspondingly preventing the disconnection of said second weight plate from said first weight plate.

7. The weight training device recited in claim 6, wherein said first weight plate also has an engagement pin movable between said retracted and extended positions and said collar also has an engagement pin channel formed therein, the engagement pin of said first weight plate being moved to the extended position at which to be received within the engagement pin channel of said collar, whereby said first weight plate is connected to said collar.

8. The weight training device recited in claim 4, wherein said lock cartridge is removable from the cartridge cavity formed in said additional weight plate.

9. The weight training device recited in claim 6, further comprising a locking cartridge, said second weight plate having a locking cartridge cavity within which to receive said locking cartridge, the engagement pin of said second weight plate being carried by and moving relative to said locking cartridge from said retracted position to said extended position at which to be received by the engagement pin channel in the coupling body of said first weight plate to prevent a disconnection of said second weight plate from said first weight plate.

10. The weight training device recited in claim 9, wherein said locking cartridge is removable from the locking cartridge cavity of said second weight plate.

11. The weight training device recited in claim 6, further comprising a position control knob attached to said engagement pin, said position control knob being manually accessible to receive a pushing force thereagainst for correspondingly causing said engagement pin to move between said retracted and extended positions depending upon the direction of said pushing force.

12. A weight training device comprising a gripping handle at which said weight training device is lifted, a first weight plate connected to said gripping handle and having a coupling body projecting therefrom, and an engagement pin channel located in said coupling body, and at least one additional weight plate to be detachably connected to said first weight plate, a lock cartridge, said additional weight plate having a cartridge cavity within which to removably receive said lock cartridge, and an engagement pin carried by and movable through said lock cartridge between retracted and extended positions relative to said first weight plate, said engagement pin being moved to the extended position at which to be removably attached to said first weight plate, whereby said additional weight plate is detachably connected to said first weight plate, and said engagement pin being moved to the retracted position at which to be removed from said first weight plate, whereby said additional weight plate is disconnected from said first weight plate, said additional weight plate including a coupling slot aligned for receipt of the coupling body of said first weight plate therewithin, said engagement pin moving to the extended position at which to be received by the engagement pin channel in the coupling body of said first weight plate at the coupling slot of said additional weight plate, whereby said additional weight plate is connected to and lifted with said first weight plate.

* * * * *